US009738948B2

(12) United States Patent
Gwaltney et al.

(10) Patent No.: US 9,738,948 B2
(45) Date of Patent: Aug. 22, 2017

(54) SNAP FIT ASSEMBLY FOR A RUGGEDIZED MULTI-SECTION STRUCTURE WITH SELECTIVE EMBRITTLEMENT OR CASE HARDENING

(71) Applicant: The United States of America as represented by the Secretary of the Navy, Washington, DC (US)

(72) Inventors: Josh Gwaltney, Sandborn, IN (US); Lucas Allison, Bloomington, IN (US); Eric Scheid, Bloomington, IN (US); Nishkamraj Deshpande, Novi, MI (US); Alan Wolf, Evansville, IN (US); Eddie Schisler, Evansville, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 15/087,245

(22) Filed: Mar. 31, 2016

(65) Prior Publication Data

US 2017/0051374 A1 Feb. 23, 2017

Related U.S. Application Data

(60) Provisional application No. 62/206,831, filed on Aug. 18, 2015.

(51) Int. Cl.
*F42B 12/22* (2006.01)
*C21D 9/16* (2006.01)
(Continued)

(52) U.S. Cl.
CPC ..... *C21D 9/16* (2013.01); *C21D 1/06* (2013.01); *C23C 8/04* (2013.01); *C23C 8/22* (2013.01);
(Continued)

(58) Field of Classification Search
CPC ..... C21D 9/16; F42B 12/22; F42B 12/367
(Continued)

(56) References Cited

U.S. PATENT DOCUMENTS 9,423,228 B2 8/2016 Moan et al.

OTHER PUBLICATIONS

Designing Snap Fit Components, Fictiv Inc., printed Mar. 21, 2016 at https://www.fictiv.com/resources/starter/designing-snap-fit-components.

(Continued)

*Primary Examiner* — Reginald Tillman, Jr.
(74) *Attorney, Agent, or Firm* — Christopher A. Monsey

(57) ABSTRACT

Apparatus and methods associated with an enclosure or structure including two sections that are adapted with a snap-fit interlocking structure. Various embodiments of the enclosure or structures are formed with various case hardening or embrittlement processes to increase embrittlement or hardness of the enclosure or structure so as to create a structure or enclosure which has a desired fragmentation capacity while still maintaining sufficient material properties to permit snap-fit insertion of one section into another section and withstand substantial impacts. Embodiments also provide an interlocking structure that minimizes differences in fragmentation or fracturing capacity as contrasted with other portions of the structure or enclosure. An embodiment of the invention includes an enclosure where one section of the enclosure or structure has a first thickness and the second section has a second thickness, wherein the first and second thicknesses are different. In some embodiments, one section is thinner than another section.

5 Claims, 18 Drawing Sheets

(51) Int. Cl.

| | |
|---|---|
| ***C21D 1/06*** | (2006.01) |
| ***C23C 8/22*** | (2006.01) |
| ***C23C 8/04*** | (2006.01) |
| ***F42B 12/20*** | (2006.01) |
| ***F42B 12/28*** | (2006.01) |
| ***F42B 33/02*** | (2006.01) |
| *F42B 12/24* | (2006.01) |

(52) U.S. Cl.
CPC ..... *F42B 12/207* (2013.01); *F42B 12/22* (2013.01); *F42B 12/28* (2013.01); *F42B 33/02* (2013.01); *F42B 12/24* (2013.01)

(58) Field of Classification Search
USPC ..... 102/493, 482
See application file for complete search history.

(56) References Cited

OTHER PUBLICATIONS

Stephen Mraz, Fundamentals of Annular Snap-Fit Joints, Jan. 6, 2005, printed Mar. 21, 2016 at http://machinedesign.com/fasteners/fundamentals-annular-snap-fit-joints.

Snap-Fit Joints for Plastics, Bayer MaterialScience, printed Mar. 21, 2016 at http://fab.cba.mit.edu/classes/S62.12/people/vernelle.noel/Plastic_Snap_fit_design.pdf.

Tim Spahr, Snap-Fits for Assembly and Disassembly, Nov. 1991, printed on Mar. 21, 2016 at http://www.gotstogo.com/misc/engineering_info/Snap_Fitsres72dpi.PDF.

Snap-Fit Design Calculator, BASF PlasticsPortal, printed on Mar. 21, 2016 at http://www2.basf.us/businesses/plasticportal/pp_techRes_tools_snapfit_en.html.

Snap-Fit Design Manual, BASF the Chemical Company, printed on Mar. 21, 2016 at http://web.mit.edu/2.75/resources/random/Snap-Fit%20Design%20Manual.pdf.

STEP 301: forming one or more materials into an enclosure comprising a first and second section, said first section comprising a first wall surrounding and defining a first cavity section, said second section comprising a second wall surrounding and defining a second cavity section, said first and second sections are adapted to be assembled at a joint section of said enclosure ;

wherein said first wall comprises a first and second wall side, wherein said first wall side is formed as an opposing side of said first wall from said second wall side, said first wall further comprises a first joint interface section;

wherein said second wall comprises a third side and fourth wall side, wherein said third wall side is formed as an opposing side of said second wall from said fourth wall side, said wall further comprises a second joint interface section;

wherein said first joint interface section is formed to insertably receive and retain said second joint interface section;

wherein said first joint interface section (female) is formed with a first,second,and third interlocking section formed at a first end of said first wall defining a first aperture into said first cavity section, said first interlocking section forms a first rib or protrusion extending away from said second interlocking section, said first interlocking section is formed with a first inwardly tapered geometry or profile defined by a first angle extending inwardly from said first side and increasing in thickness from said first end to a first shoulder section of said first interlocking structure, said first interlocking section is formed with said first shoulder section defining a first transition between said first interlocking section to said second interlocking section, said first shoulder formed with a shoulder wall extending perpendicularly away from said second interlocking section, said second interlocking section has a different thickness than said first or third interlocking sections wherein said second interlocking section's thickness is less than said first or second interlocking sections, said third interlocking section is formed with a second inwardly tapered geometry or profile defined by a second angle extending inwardly from said first side and increasing in thickness from a second transition between said second and third interlocking sections to a second shoulder formed into said first section that extends away from said third interlocking section to said second side of said first wall, wherein said first interlocking section has a chamfered or rounded edge at said first end at said first aperture's edge to facilitate said second section insertion into said first section;

FIG. 15A

SNAP FIT ASSEMBLY FOR A RUGGEDIZED MULTI-SECTION STRUCTURE WITH SELECTIVE EMBRITTLEMENT OR CASE HARDENING

CROSS-REFERENCE TO RELATED APPLICATION

The present application claims priority to U.S. Provisional Patent Application Ser. No. 62/206,831, filed Aug. 18, 2015, entitled "SNAP FIT ASSEMBLY FOR A RUGGEDIZED MULTI-SECTION STRUCTURE WITH SELECTIVE EMBRITTLEMENT OR CASE HARDENING," and is related to U.S. patent application Ser. No. 14/689,696, filed Apr. 17, 2015, entitled "FRAGMENTATION DEVICE WITH INCREASED SURFACE HARDNESS AND A METHOD OF PRODUCING THE SAME", the complete disclosures of which are expressly incorporated by reference herein.

STATEMENT REGARDING FEDERALLY SPONSORED RESEARCH OR DEVELOPMENT

The invention described herein includes contributions by one or more employees of the Department of the Navy made in the performance of official duties and may be manufactured, used and licensed by or for the United States Government without payment of any royalties thereon. This invention (Navy Case 200,274) is assigned to the United States Government and is available for licensing for commercial purposes. Licensing and technical inquires may be directed to the Technology Transfer Office, Naval Surface Warfare Center Crane, email: Cran_CTO@navy.mil.

BACKGROUND AND SUMMARY OF THE INVENTION

The present invention relates to creating an improved coupling structure which provides a strong coupling force and avoids use of welding or other permanent joining manufacturing approach. Embodiments are also directed to designing structures which are designed to destructively disassemble with a different and more desirable fragmentation pattern.

One purpose of various embodiments of the invention is to securely assemble a structure, such as a hollow steel enclosure. An exemplary assembly can be designed to remain secure after strong impacts and repeated abuse. One exemplary assembly can be mechanical and designed avoiding the use of welding, adhesives or threads. Aesthetically, an exemplary assembly can minimize a seam. One exemplary need for certain embodiments of the invention arose from a desire to enclose a pressed explosive within a rugged steel case.

Some methods of assembly include at least welding, threading, adhesive bonding, pressing and shrink fitting. There is a need for a fragmentation structure with improved performance. Some resulting designs can include a solid warhead case surrounding a pressed explosive. One advantage of this design is that it combines energy transfer and economic benefits of breaking a case (rather than projecting embedded objects in a composite case) and an added chemical energy available from pressed explosive relative to cast or chemically cured compositions. Additionally, production and logistical needs of a pressed explosive production process are more efficient and environmentally friendly relative to cast or cured processes.

Existing solutions to forming a body for some fragmentation involve preassembly of the enclosure and then pouring the explosive in through a small opening. Often this involves welding an assembly. Welding can result in altering the metallurgical properties to the extent that fragmentation performance is compromised. Additionally, the geometry of the interface is affected by welding and difficult to control. Welding after explosive loading is unsafe. Other approaches (threading, etc.) of pre-assembly are possible but prevent the application of a pressed explosive as access to the cavity remains limited to a small opening.

Threading the enclosure around an explosive load is undesired due to safety and production concerns. Threads provide the opportunity to initiate stray explosive material with friction generated heat and are generally considered bad practice for energetic production. Another need is a requirement to minimize a distance of threaded interfaces which trends towards the need of fine threads. Additionally, threading gives rise to a need for rotating equipment. Another need is to provide an ability to provide a "final set" in pressed explosives which can be facilitated by a design employing pressing an assembly closed.

A press fit assembly, with and without adhesive bonding, was investigated. Various embodiments showed promise as it met all of the production requirements. However, it was not able to withstand rough handling testing believed required for various applications. Experimental efforts included experimentation with various metal to metal retaining adhesive compounds which did not provide necessary coupling results.

Various designs and methods of manufacturing have been developed including a "snap" fit assembly design. One exemplary design provided sufficient mechanical interface to remain assembled without movement after impacts and rough handling as well as avoiding structural designs which would interfere with fragmentation of assembly material in and next to various mechanical interfaces including various snap fit structures. Additionally, various design embodiments provided a capacity for production with various advantages including a design that required relatively little force to assemble but resulted in a need for a large force to pull apart a mechanical interface. An exemplary mechanical interface in accordance with various embodiments of the invention does not require chemical (adhesive) bonding and can have a strength greater than enclosure sections mechanically coupled. Further, if desired, snap fit assembled parts have the ability to rotate relative to each other.

Apparatuses and methods associated with an enclosure or structure are provided including two sections that are adapted with a snap-fit interlocking structure. Various embodiments of the enclosure or structure are formed with various case hardening or embrittlement processes to increase embrittlement or hardness of the enclosure or structure so as to create a structure or enclosure which has a desired fragmentation capacity while still maintaining sufficient material properties to permit snap-fit insertion of one section into another section and withstand substantial impacts. Embodiments also provide an interlocking structure that minimizes differences in fragmentation or fracturing capacity as contrasted with other portions of the structure or enclosure. An embodiment of the invention includes an enclosure where one section of the enclosure or structure has a first thickness and the second section has a second thickness wherein the first and second thicknesses are different. In some embodiments, one section is thinner than another section.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which:

FIG. 15A shows an exemplary method of producing an embodiment of the present disclosure.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Figure 1:
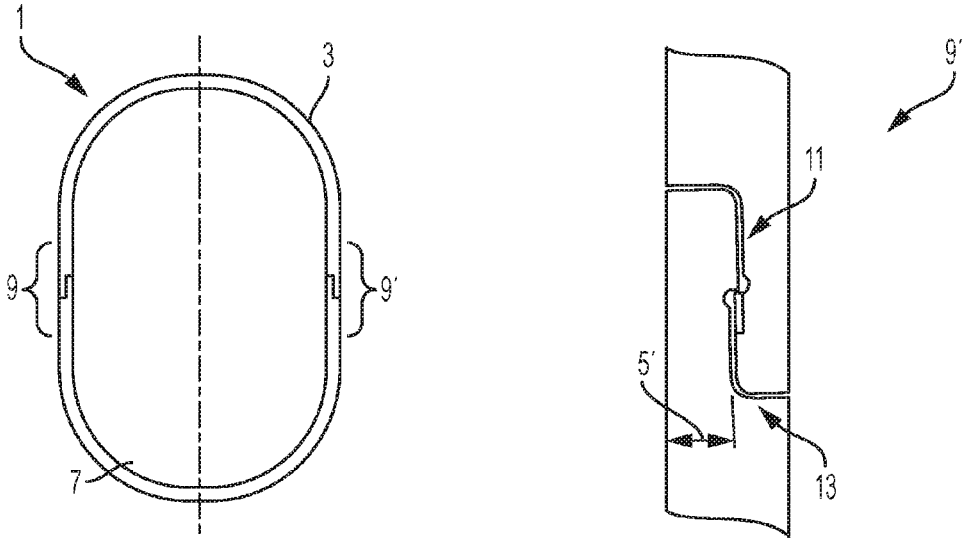
FIG. 1 shows a cross-sectional view of a hollow structure with two sections and a mechanical interface in accordance with one illustrative embodiment of the invention.

Referring to FIG. 1, an exemplary mechanical interface for an enclosure 1 is shown. In particular, a snap fit interface section 9 is shown with of a male 13 and a female 11 couple that is pressed together and interlocks. Assembly can be performed under loads achievable with a common, hand operated Arbor press. Another feature of the invention is a design which includes various types of embrittlement or case hardening manufacturing processes which increase fracturing of the enclosure at the snap fit interface section rather than increasing its resistance to fracturing or fragmentation. Embodiments of manufacturing exemplary embodiments include snap fitting or coupling the snap fit interface sections after case hardening or embrittlement is completed while still being able to deform for snap fit insertion without cracking or breaking of the enclosure 1 or snap fit interface section 9, 9'.

An exemplary "snap" fitting can include a circular connection that requires an outer (female) shell 3 to flex slightly under loading (interference) from a inner (male) shell 7 and "snap" back into position after fitting's parts clear an interference area. In some embodiments of the invention, an important feature of an exemplary design can include a ratio of wall thicknesses. An exemplary female snap interface section 11 can be designed to be thinner than a male snap interface section 13 allowing the female part's wall to deform without cracking or breaking and also reducing plastic deformation. The exemplary female snap interface section 11 can be formed to return to its pre-deformation form and thus lockably engaging with the male snap interface section. An exemplary result can include a mechanical interface or bond able to withstand strong impacts and rough handling without dislodging. Without various design elements, a female snap interface section 11 would deform and not return to its pre-engagement shape allowing the exemplary male and female parts to separate at the snap fit interface section 9, 9'.

Figure 2:
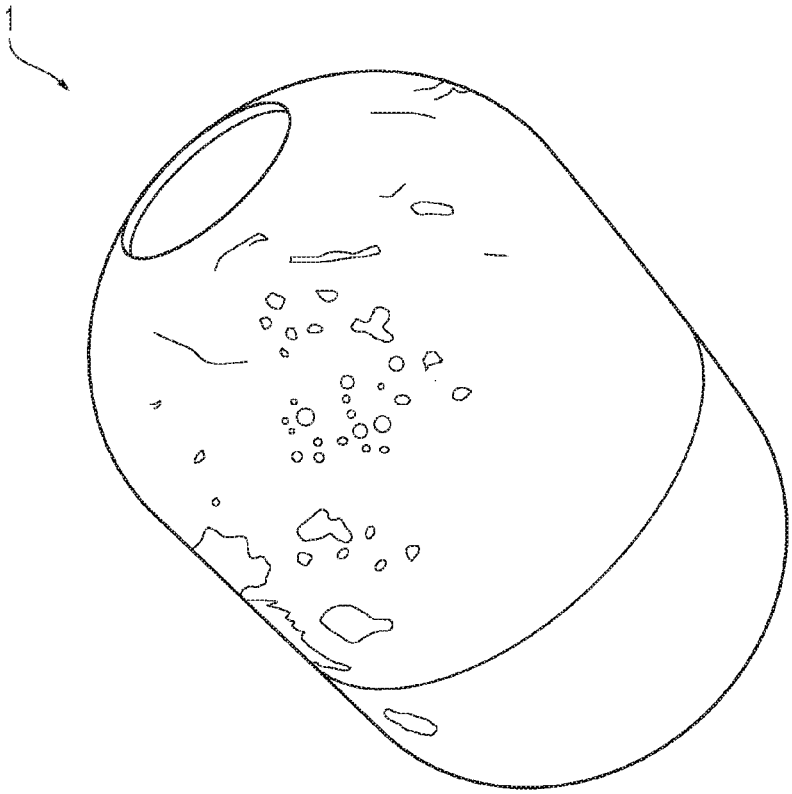
FIG. 2 shows an exterior view of exemplary embodiment that has been subjected to rough handling and impacts which resulted in superficial surface damage without loss of structural integrity of the disclosed assembly.

Referring to FIG. 2, an example of a part that has been assembled and abused to the point of denting and bending is shown. This exemplary enclosure 1 was thrown and dropped in a variety of ways which resulted in abrasion and minor damage to an external section of the part. The part's mechanical interface, e.g., snap fit interface, remained engaged even with high degree of impacts.

Figure 3:
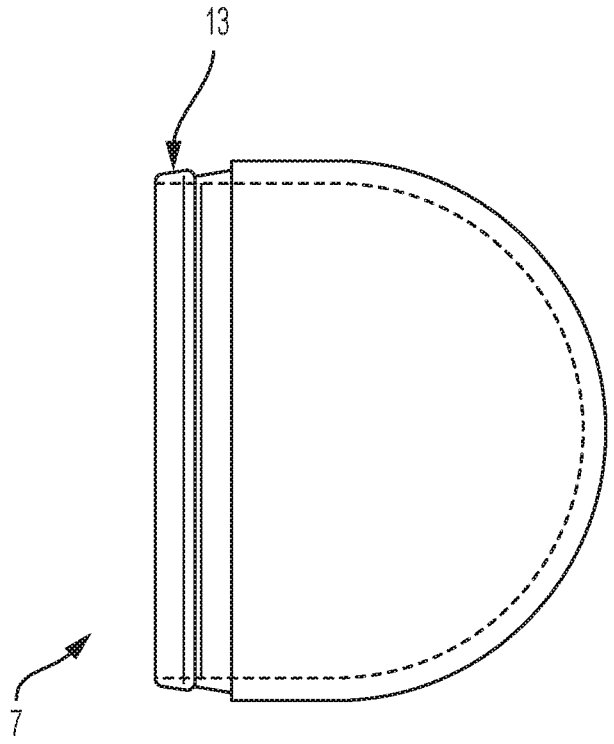
FIG. 3 shows a side view of one section (e.g., male) of an exemplary embodiment in accordance with one variant of the invention.

FIG. 3 shows a side view of one inner shell 7 section of an exemplary embodiment in accordance with one variant of the invention and the male snap interface section 13. One exemplary embodiment forms male snap interface section 13 to lock into a complementary fit with the female snap interface section 11.

Figure 4:
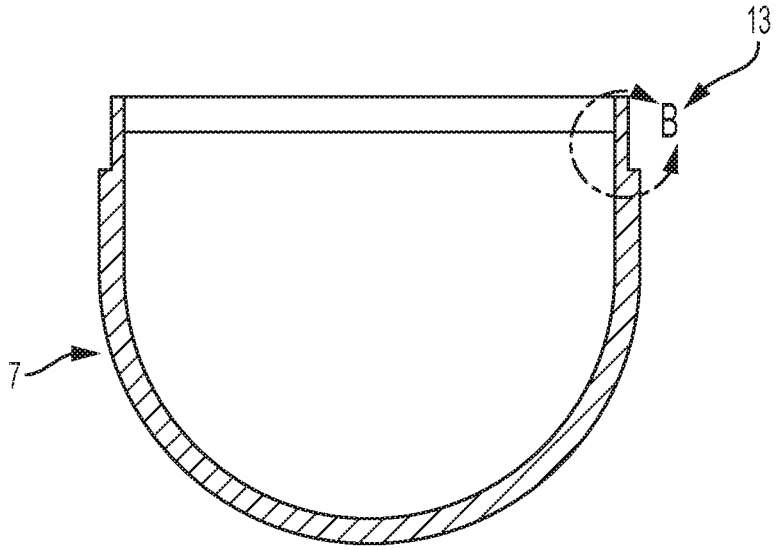
FIG. 4 shows a cross-sectional view of the FIG. 3 embodiment.

FIG. 4 shows a cross sectional view of the FIG. 3 embodiment displaying the inner (male) shell 7. Exemplary male snap interface section 13 displayed as a thinner inner geometric section that interlocks with the complimentary female snap interface section 11.

Figure 5:
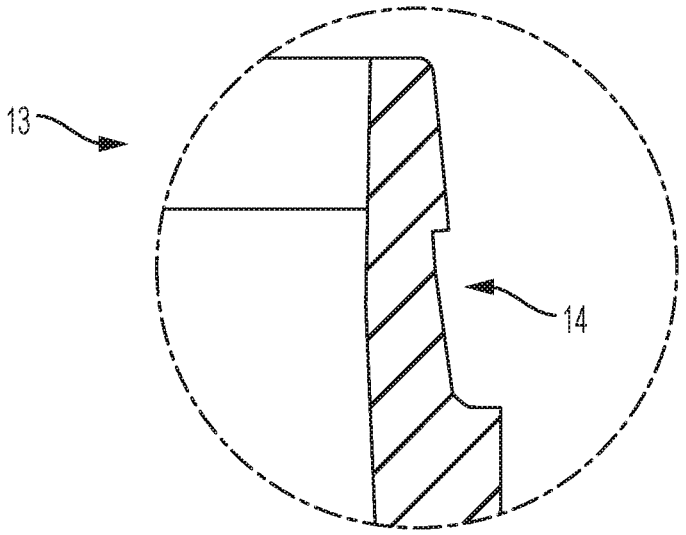
FIG. 5 shows a cross-sectional detail view (Detail B) of a joint interface section of the FIG. 4 embodiment.

FIG. 5 shows a cross sectional detail view a male snap interface section 13 of the FIG. 4 embodiment. Exemplary recessed section 14 displays the interlocking component that complimentary fits female snap interface section 11 for stability.

Figure 6:
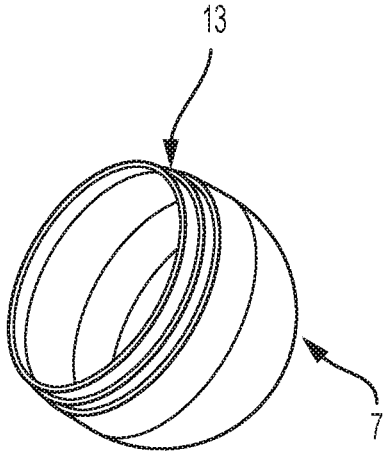
FIG. 6 shows an isometric perspective view of the FIGS. 3-5 exemplary embodiment.

FIG. 6 shows an isometric perspective view of the FIGS. 3-5 exemplary embodiment of inner (male) shell 7 with male snap interface section 13

Figure 7:
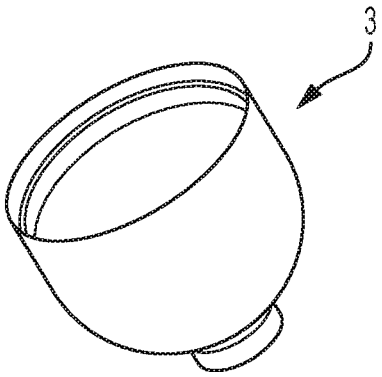
FIG. 7 shows an isometric perspective view of another section (e.g., female) of an exemplary embodiment used in relation to the FIGS. 3-6 embodiment of the invention.

FIG. 7 shows an isometric perspective view of another section (e.g. outer female shell 3) of an exemplary embodiment used in relation to the FIGS. 3-6 embodiment of the invention.

Figure 8B:
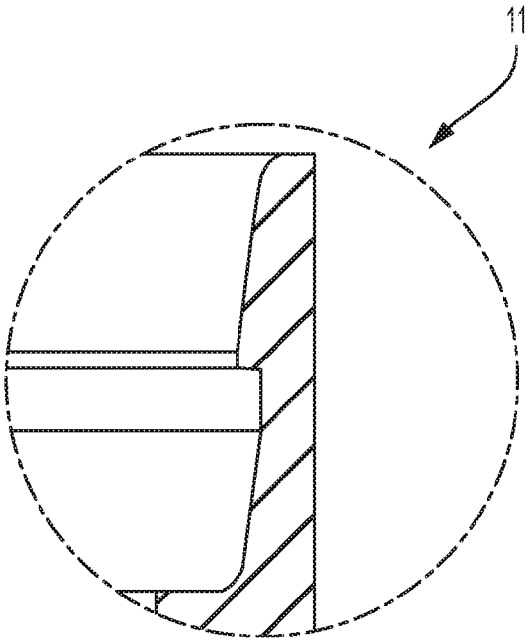
FIG. 8 shows a cross sectional view and a related detail view of the FIG. 7 embodiment.
Figure 8A:
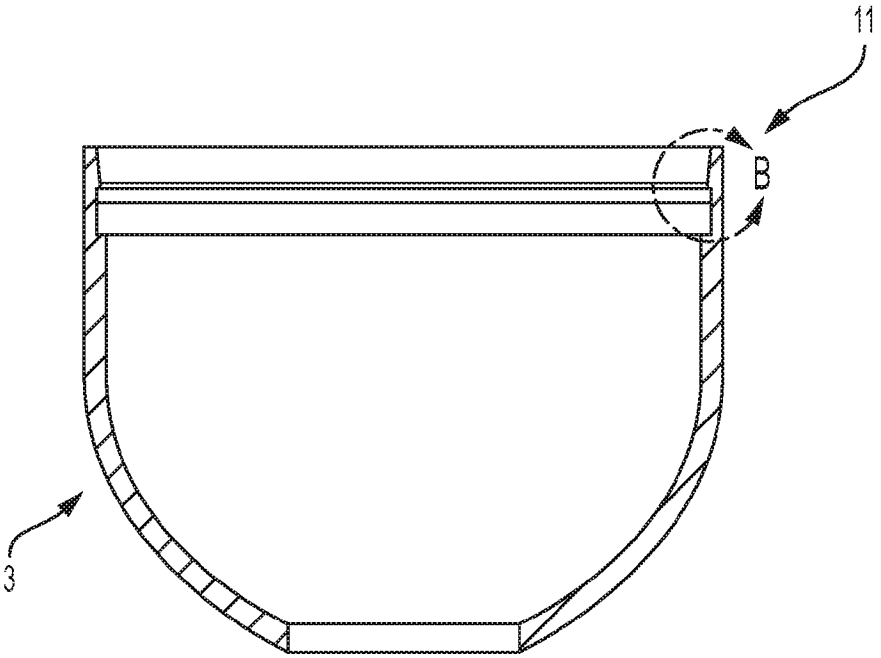

FIG. 8 shows a cross sectional view and a related detail view of the FIG. 7 embodiment displaying the outer (female) shell 3 with an expanded view of the female snap interface section 11. Exemplary female snap interface section 11 is built to expand around the male snap interface section 13 in a snap fit interface section 9, 9'.

Figure 9A:
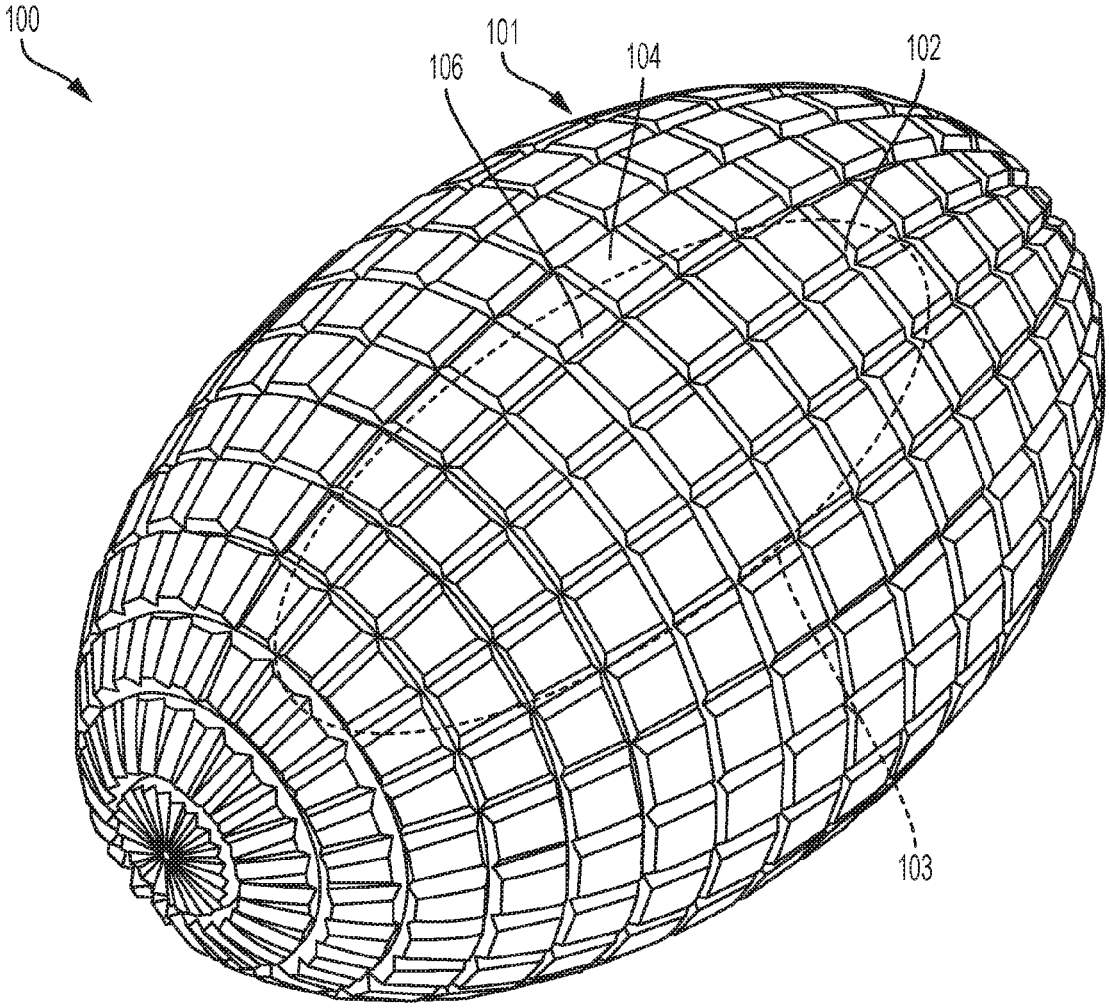
FIG. 9A shows a perspective view of an exemplary alternative embodiment of an assembly or structure, e.g., fragmentation device, of the present disclosure.

FIG. 9*a* shows another embodiment of the present disclosure that can include a fragmentation device 100 that includes a body or fragmentation structure 101 which generally surrounds an energetic device, illustratively an explosive material or core 103. Body or fragmentation structure 101 may be comprised of a metallic, polymeric, and/or ceramic material, depending on the application of fragmentation device 100. Illustratively, fragmentation device 100 is a munition device defining a grenade comprised of a metallic material, however, fragmentation device 100 may be a bullet, missile, other ammunition, or any other device configured to fragment into a plurality of components. Alternatively, fragmentation device 100 may have non-military applications, such as a computer hard drive or an electrical component designed to fragment under predetermined conditions.

Figure 9B:
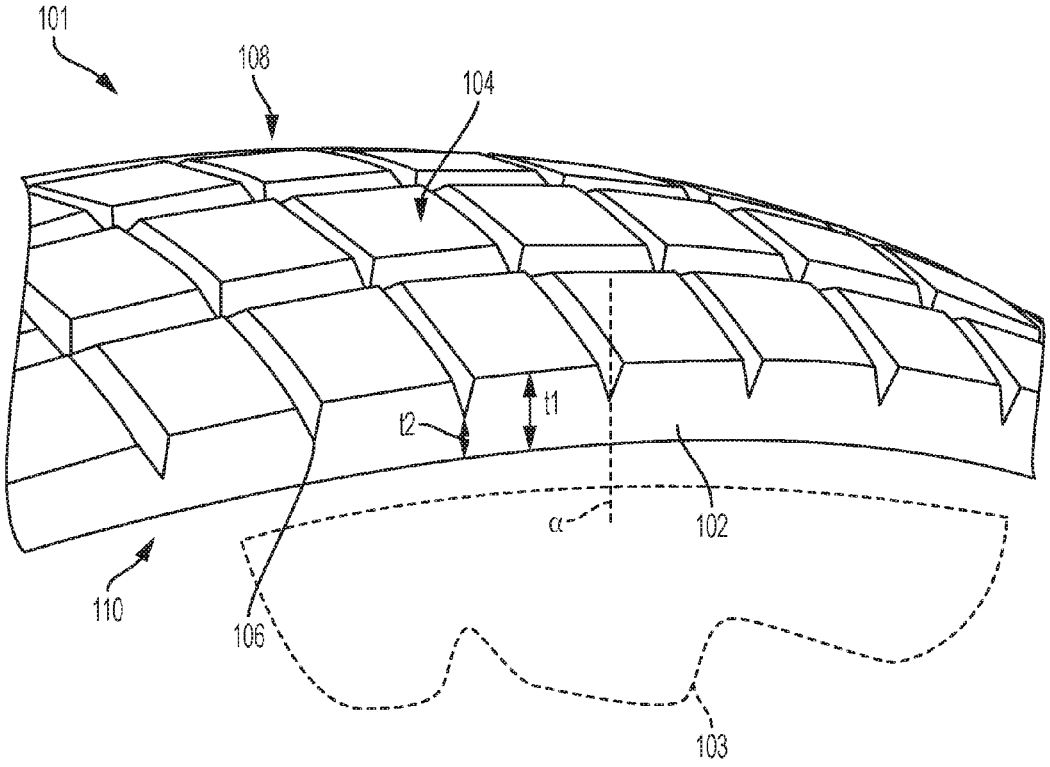
FIG. 9B shows a partial cross-sectional view of a surface of the exemplary alternative embodiment of an assembly or structure, e.g., fragmentation device, of FIG. 9A, with an explosive core shown in phantom lines.

Referring to FIGS. 9A and 9B, body 101 of fragmentation device 100 includes an outer surface 108, defining the outermost surface of body 101, and an inner surface 110, defining the innermost surface of body 101. While exemplary inner surface 110 is a smooth and continuous surface, exemplary outer surface 108 of body 101 includes a pattern or grid 102 of projections 104, defined as raised portions, and valleys 106, defined as grooves, within the material of body 101 that surrounds explosive material 103. Projections 104 define the individual fragments of fragmentation device 100 such that when explosive material 103 ignites, body 101 is intended to fracture at each valley 106 and project fragments, defined by each projection 104, outwardly. Illustratively, projections 104 define square fragments, however, projections 104 may be formed in any configuration to define differently shaped fragments. In one embodiment, the thickness of body 101 at projections 104 may be approximately 0.050 inches, 0.055 inches, 0.060 inches, 0.065 inches, 0.070 inches, 0.075 inches, 0.080 inches, 0.085 inches, 0.090 inches, 0.100 inches, or within any range delimited by any of the foregoing pairs of values. The thickness of body 101 also may be orders of magnitude greater, for example, 1.0-5.0 inches, depending on the application of fragmentation device 100. Additionally, in a further embodiment, projections 104 may be non-planar.

Valleys 106 are recessed relative to projections 104 and may be angled inwardly relative to projections 104 to define a taper. In one illustrative embodiment, valleys 106 may be tapered at an angle $\alpha$ which is approximately 45° from the peak of valley 106 (see FIG. 9B). In one illustrative embodiment, valleys 106 also may extend into body 101 by approximately 0.001 inches, 0.005 inches, 0.010 inches, 0.015 inches, 0.020 inches, 0.025 inches, 0.030 inches, 0.035 inches, 0.040 inches, 0.050 inches, or within any range delimited by any pair of the foregoing values. In this way, and as shown in FIG. 9B, body 101 has a first thickness, t1, defined by the thickness at projections 104, and a second thickness, t2, defined by the thickness at valleys 106, and the second thickness is less than the first thickness. Because the thickness of body 101 at valleys 106 is reduced, valleys 106 define stress points on body 101 such that fragmentation of body 101 occurs at valleys 106.

Figure 9C:
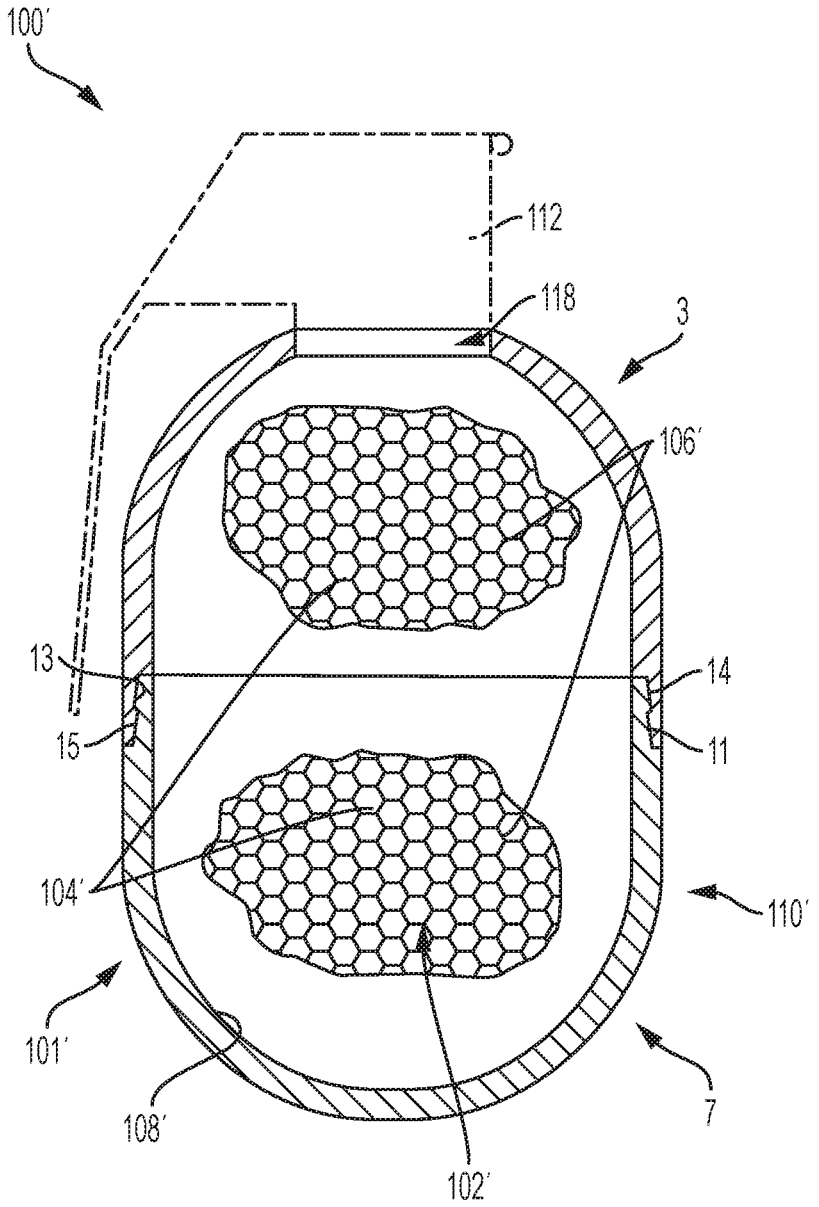
FIG. 9C shows a cross-sectional view of an exemplary alternative embodiment of an assembly or structure, e.g., fragmentation device, of the present disclosure, illustrating a partial cut-away in a first portion and a partial cut-away in a second portion of the fragmentation device.
Figure 9D:
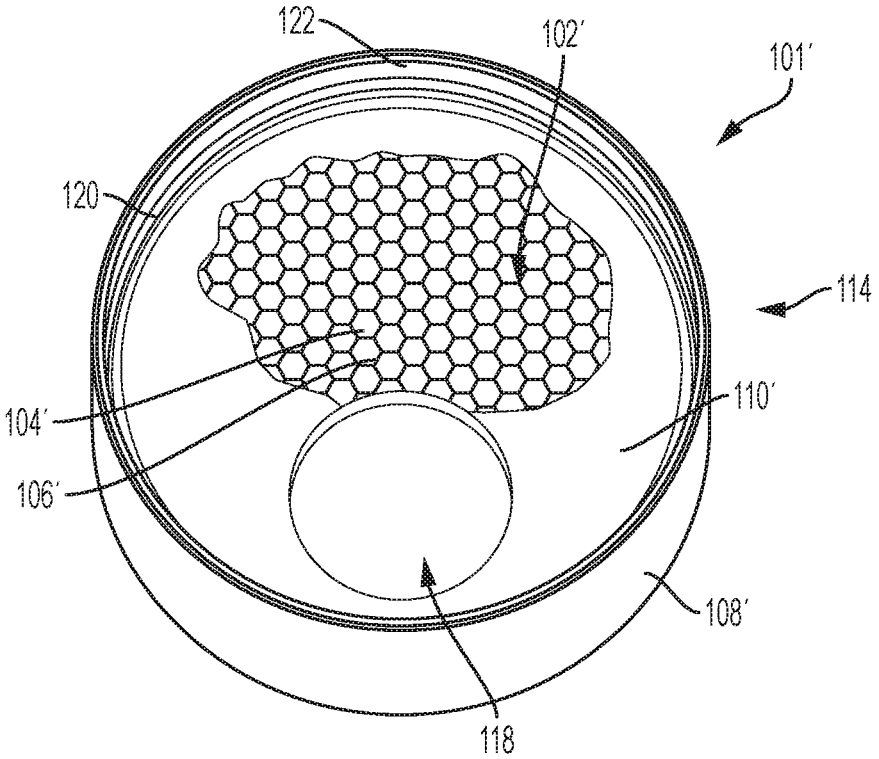
FIG. 9D shows a perspective view of the first portion of the alternative assembly or structure, e.g., fragmentation device, of FIG. 9C, illustrating a portion of a pattern on an inner surface of the fragmentation device.
Figure 9E:
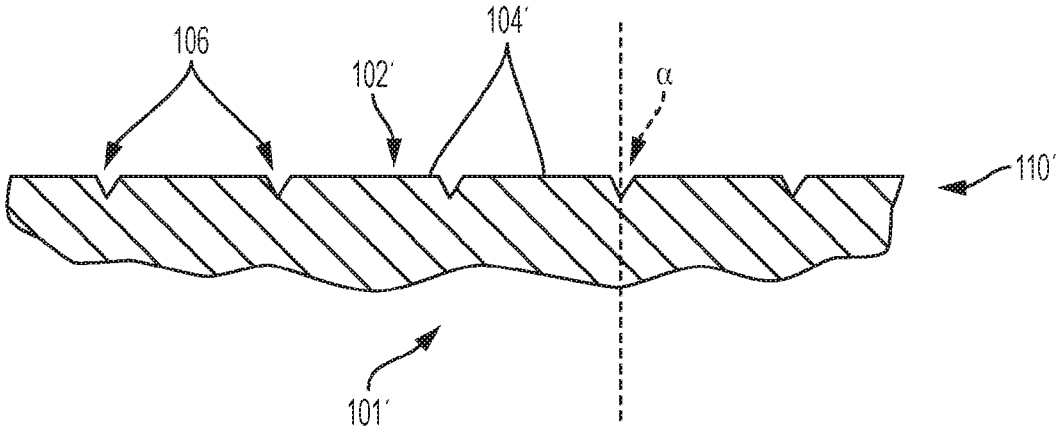
FIG. 9E shows a cross-sectional view of a portion of the surface of the alternative embodiment shown in FIG. 9C.

Referring to FIGS. 9C, 9D and 9E, an alternative embodiment of fragmentation device 100 is shown as fragmentation device 100'. In one embodiment, fragmentation device 100' is a grenade configured to project a plurality of fragments during an explosive event. Fragmentation device 100' includes a body or fragmentation structure 101', explosive material 103, and a detonation device 112 (shown in phantom in FIG. 9C) which is connected with explosive material 103 and coupled to body 101'. Body 101' includes a first outer (female) shell 3 and a second inner (male) shell 7 which are removably or permanently coupled together.

First outer shell 3 includes an aperture 118 for receiving detonation device 112. Additionally, outer shell 3 includes a protruding female snap interface section 11 and a recessed section 14, both extending circumferentially around an open end of outer (female) shell 3. Similarly, inner (male) shell 7 includes a protruding male snap interface section 134 and a recessed member 15, both also extending circumferentially around an open end of inner (male) shell 7. More particularly, protruding female snap interface section 11 of first outer (female) shell 3 is configured to be received within recessed member 15 of inner (male) shell 7, and protruding male snap interface section 13 of inner (male) shell 7 is configured to be received within recessed member 14 of outer (female) shell 3 in order to retain outer and inner shell portions 3, 7 together. As discussed herein, outer and inner shell sections 3, 7 can be coupled together through a snap-fit connection between protruding female and male snap interface sections 11, 13 and recessed members 14, 15.

Both outer and inner shell portions 3, 7 of fragmentation device 100' include an outer surface 108', which defines the outermost surface of body 101', and an inner surface 110', which defines the innermost surface of body 101'. In one embodiment, outer surface 108' is a smooth and continuous surface. However, exemplary inner surface 110' may include a grid 102' which includes a plurality of projections 104' and valleys 106'. As shown in FIGS. 9C and 9D, grid 102' may define a honeycomb pattern on inner surface 110' of fragmentation device 100'. In one embodiment, grid 102' is defined on both inner surface 110' and outer surface 108'.

Projections 104' define the individual fragments of fragmentation device 100' such that when explosive material 103 ignites, body 101' is intended to fracture at each of valleys 106' and project the fragments, defined by each projection 104', outwardly. Illustratively, projections 104' define hexagonal fragments, however, projections 104' may be formed in any configuration to define differently shaped fragments. In one embodiment, the thickness of body 101' at projections 104' may be approximately 0.050 inches, 0.055 inches, 0.060 inches, 0.065 inches, 0.070 inches, 0.075 inches, 0.080 inches, 0.085 inches, 0.090 inches, 0.100 inches, or within any range delimited by any of the foregoing pairs of values. The thickness of body 101' also may be orders of magnitude greater, for example, 1.0-5.0 inches, depending on the application of fragmentation device 100'.

Valleys 106' are recessed relative to projections 104' and may be angled inwardly relative to projections 104' to define a taper. In one embodiment, valleys 106' may be tapered at an angle α which is approximately 45° from the peak of valley 106'. Valleys 106' also may extend into body 101' by approximately 0.001 inches, 0.005 inches, 0.010 inches, 0.015 inches, 0.020 inches, 0.025 inches, 0.030 inches, 0.035 inches, 0.040 inches, 0.050 inches, or within any range delimited by any pair of the foregoing values. In this way, body 101' has a first thickness, defined by the thickness at projections 104', and a second thickness, defined by the thickness at valleys 106', and the second thickness is less than the first thickness. Because the thickness of body 101' at valleys 106' is reduced, valleys 106' define stress points on body 101' such that fragmentation of body 101' occurs at valleys 106'.

Figure 9F:
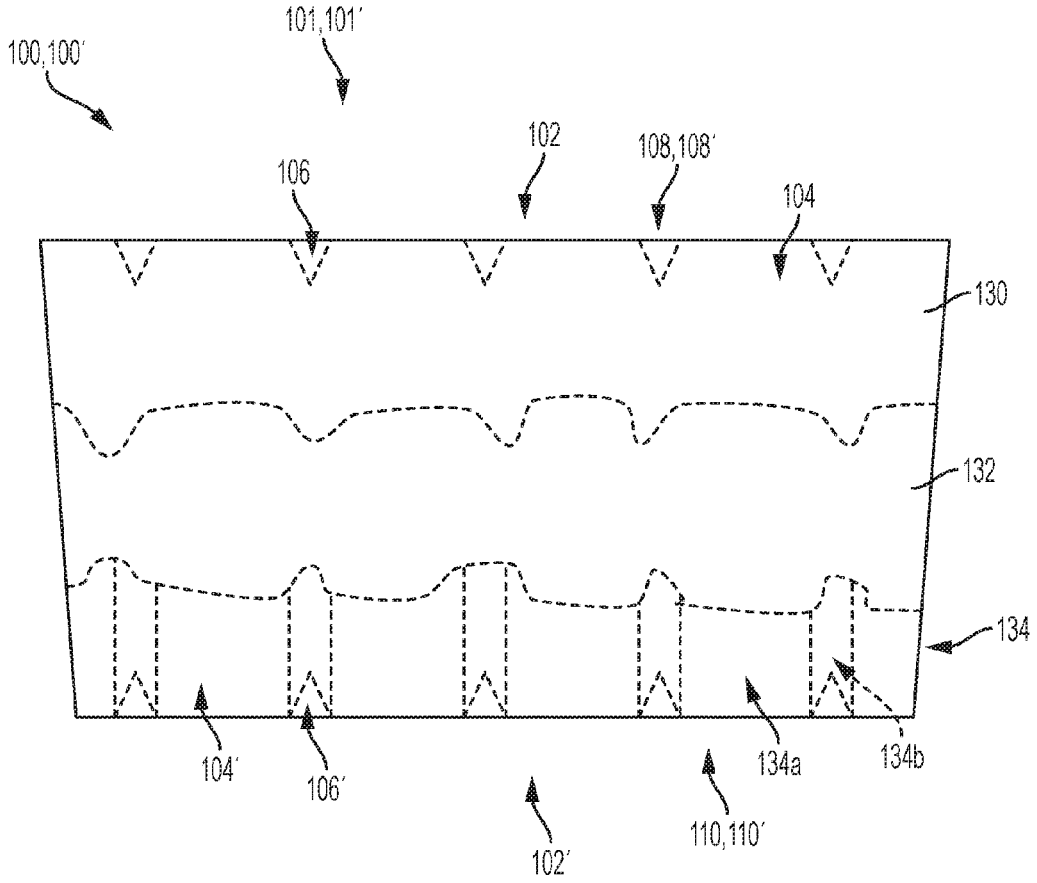
FIG. 9F shows a more detailed view of an exemplary simplified depiction of results of an embodiment that has been case hardened or embrittled in accordance with one embodiment of the invention.

Referring to FIG. 9F, body 101, 101' of an enclosure or structure 100, 100' may be comprised of a material with varying hardness throughout. For example, body 101, 101' may be comprised of steel, such as AISI 1008 carbon steel. In one embodiment, body 101, 101' is comprised of 1008 steel which contains at least carbon, manganese, phosphorus, sulfur, silicon, aluminum, boron, chromium, copper, nickel, niobium, nitrogen, tin, titanium, and vanadium. The steel comprising body 101, 101' may be low-carbon steel having a carbon content of approximately 0.01-2.0 wt. % carbon and, more particularly, may be 0.05 wt. % carbon.

While the entire thickness of body 101, 101' may be comprised of steel, the hardness of the steel of body 101, 101' may be different at different distances from outer surface 108, 108'. As shown in FIG. 9F, body 101, 101' may include at least three depths or portions of material with varying hardness values. An outermost depth or portion 130 of body 101, 101' includes outer surface 108, 108', an innermost depth or portion 134 of body 101, 101' includes inner surface 110, 110', and an intermediate depth or portion 132 is positioned between outermost depth 130 and innermost depth 134. As shown in FIG. 9F, outermost depth 130 or innermost depth 134 each may include a first section 134*a* defined by projections 104, 104' and a second section 134*b* defined by valleys 106, 106', intermediate depth 132 may define a third section of body 101, 101', and, if the other of outermost depth 130 and innermost depth 134 defines a fourth section of body 101, 101'. As shown in FIG. 9F, first and second sections 134*a*, 134*b* are shown as being separated by phantom lines, however, it should be understood that first and second sections 134*a*, 134*b* are both within innermost depth 134 and, therefore, are comprised of the same material and are not physically separated sections of innermost depth 134.

In one embodiment, outermost depth 130 has a hardness value which is greater than that of intermediate depth 132 and may be generally the same as innermost depth 134. However, in other embodiments, the hardness value of outermost depth 130 may be greater than or less than the hardness value of innermost depth 134. Illustrative depths 130, 132, 134 may have hardness values on the Rockwell C scale of 5, 10, 15, 20, 25, 30, 35, 40, 45, 50, 55, 60, 65, 70, 75, or within any range delimited by any pair of the foregoing values.

In order to adjust the hardness value of body 101, 101', depending on the distance from outer surface 108, 108', various processing methods may be used when forming body 101, 101'. For example, body 101, 101' may be subjected to a heat treatment process which may involve annealing, carburizing, carbonitriding, case hardening, precipitation strengthening, tempering, induction surface hardening, differential hardening, flame hardening, and quenching. Heat treatment processes may be used with metallic materials to adjust the strength and hardness of the material. More particularly, heat treatment processes may alter the physical and/or chemical properties of the material comprising body 101, 101' to modify the hardness, strength, toughness, ductility, and elasticity thereof.

In one embodiment, body 101, 101' undergoes a case hardening heat treatment process to increase the hardness of varying portions of body 101, 101'. In particular, case hardening is a process that may increase the hardness of outermost depth 130 and innermost depth 134 of body 101, 101' while allowing intermediate depth 132 to retain its natural physical properties (i.e., natural hardness). In this way, outermost and innermost depths 130, 134 have increased surface hardness relative to intermediate depth 132 which makes outermost and innermost depth 130, 134 slow to wear and increases the strength of fragmentation device 100, 100'. More particularly, case hardening creates more brittle outermost and innermost depths 130, 134 while allowing intermediate depth 132 to remain more ductile and tougher relative to the outermost and innermost depths 130, 134.

For example, if body 101, 101' is comprised of steel, a carburizing process is one method of creating a case hardened fragmentation device 100, 100'. Carburizing occurs by positioning body 101, 101' within a carbon-rich environment and then heating body 101, 101' to a predetermined temperature. More particularly, carburizing is the addition of carbon to a surface of low-carbon steels at temperatures of 750° C., 800° C., 850° C., 900° C., 950° C., 1000° C., 1050° C., 1100° C., 1150° C., 1200° C., or within any range delimited by any of the foregoing pairs of values. While held at a specific temperature, the material comprising body 101, 101' absorbs some of the surrounding carbon content, which may be provided by carbon monoxide gas and/or other sources of carbon. By increasing the carbon content at outer surface 108, 108' and inner surface 110, 110', the material at those portions of body 101, 101' will have increased hardness relative to the portions of body 101, 101' which were not directly exposed to the carbon. In one embodiment, the carbon content at outer surface 108, 108' and/or inner surface 110, 110' increases from approximately 0.05 wt. % carbon to approximately 0.2 wt. % carbon.

Additionally, the length of time that body 101, 101' is carburized may vary, depending on the depth within body 101, 101' that carbon is intended to penetrate. For example, when body 101, 101' is positioned within the carbon-rich environment for longer periods of time, carbon is absorbed deeper into body 101, 101' such that some amount of carbon may be absorbed into intermediate depth 132, rather than just absorbed at outermost and innermost depths 130, 134. However, if carburizing occurs for shorter amounts of time, carbon is not absorbed within intermediate depth 132 such that intermediate depth 132 retains the natural ductility of the material comprising body 101, 101'. As such, intermediate depth 132 has reduced hardness and increased ductility relative to outermost and innermost depths 130, 134. More particularly, when heated within the carburizing chamber (not shown), austenite has a high solubility for carbon such that carbon is absorbed into outermost and innermost depths 130, 134 but not into intermediate depth 132. When cooled, for example by quenching, the higher-carbon content at outermost and innermost depths 130, 134 forms martensite which has good wear and fatigue resistance. In one embodiment, a carburizing process may be combined with other heat treatment processes, such as nitriding, induction surface hardening, differential hardening, and/or flame hardening, to modify the hardness of body 101, 101'. Additional details of an illustrative carburizing process may be disclosed in U.S. Pat. No. 4,152,177, which issued on May 1, 1979, the complete disclosure of which is expressly incorporated by reference herein.

As shown in FIG. 9F, the carbon profile of outermost depth 130 and/or innermost depth 134 may not be planar because similar amounts of carbon are absorbed into outermost depth 130 and/or innermost depth 134 through both projections 104, 104' and valleys 106, 106'. However, because the thickness of body 101, 101' at projections 104, 104' is greater than the thickness of body 101, 101' at valleys 106, 106', carbon may penetrate deeper into outermost depth 130 and/or innermost depth 134 at valleys 106, 106' when compared to the carbon penetration depth at projections 104, 104'. As such, the carbon profile of outermost depth 130 and/or innermost depth 134 may not be planar, but instead, may follow the thickness profile of body 101, 101' at projections 104, 104' and valleys 106, 106'. In this way, the boundary defining intermediate depth 132, the portion of body 101, 101' which maintains its original carbon content and is not hardened through the carburizing process, also may not be planar.

By increasing the hardness of portions of body 101, 101', those portions thereof may become more brittle. As such, those portions of body 101, 101' may undergo brittle fracture rather than elastic or plastic deformation during an explosive event. More particularly, because fragmentation device 100, 100' is an explosive device, by using a case hardening process, such as carburization, when manufacturing fragmentation device 100, 100', body 101, 101' may be configured to uniformly project the individual fragments, defined by the individual projections 104, 104', at a high rate of speed. Additionally, because various portions of body 101, 101' are made more brittle through a case hardening process, body 101, 101' may be more likely to fracture at each valley 106, 106', thereby increasing the number of fragments formed during an explosive event of fragmentation device 100, 100'.

As noted above, embrittlement or an alternate approach to case hardening can be employed as a process that may increase the hardness of at least a portion of a structure or enclosure while allowing a section underneath a surface at an intermediate depth to retain its natural physical properties (i.e., natural hardness). In some embodiments, both inner and outer walls of a structure or container can be subjected to such case hardening treatment to create a result where an innermost depth from an interior wall or one wall of a structure or enclosure as well as an outermost depth of an opposing wall or structure has one hardness or embrittlement and a section underneath or in between retains its natural physical properties (e.g., natural hardness). As noted herein, creating a structure with different embrittlement profiles that have an increased surface hardness relative to intermediate depth improves wear, increases the strength of fragmentation device in one way, while increasing its brittleness or capacity in another way. More particularly, case hardening can be done to create more brittle outermost and/or innermost depths while allowing an intermediate depth to remain more ductile and tougher relative to the outermost and innermost depths.

An exemplary method of manufacturing structure or assembly can include identifying a type of fragmentation device to be formed. For example, fragmentation device may be selected to form a military device, such as a grenade or other type of ammunition. Alternatively, fragmentation device may be selected to form a non-military device, such as a hard drive or an electrical component. Whichever type of fragmentation device selected, some exemplary designs of a structure or assembly can be design to have desired ability to operate in an intended environment with an ability to withstand certain types of impacts while still providing fragmentation capabilities to facilitate rending the structure or assembly destroyed or rendered inoperable after application of a force to the structure or assembly to generate a plurality of fragments. In this exemplary method, one step would include determining available material options for both body and a force generating material, depending on the type of structure or assembly desired to be designed as a fragmentation device, a size of fragmentation device, and/or the application or force generator suitable to initiate a destruction or fragmentation result.

Another step can include modifying the selected material and then etching, casting, machining, stamping, pressing, or otherwise imprinting different structures into the material, e.g., with grid 102, 102' to define projections 104, 104' and valleys 106, 106'. As shown in FIGS. 1 and 3, grid 102, 102' may be applied to body 101, 101' to define square-shaped fragments and/or hexagonal fragments. Additionally, grid 102, 102' may be applied to outer surface 108, 108' and/or inner surface 110, 110'.

At another step, after imprinting grid 102, 102' onto the material previously for body 101, 101', that material of body 101, 101' may be formed into the desired shape for fragmentation device 100, 100'. For example, the material selected for body 101, 101' may be drawn or otherwise shaped into the overall fragmentation device 100, 100' or into various components of fragmentation device 100, 100', such as outer and inner shell portions 3, 7.

Another step may occur before or after forming into a desired shape that can include selecting processing parameters for body 101, 101'. More particularly, depending on the application of fragmentation device 100, 100', it may be desired to modify the material properties of body 101, 101'. For example, it may be desired to increase the hardness of outermost and/or innermost depths 130, 134 (FIG. 9E) through a heat treatment process, such as a carburizing case hardening process. Therefore, material strength and degradation data may be analyzed to determine the parameters of the heat treatment process. For example, heat treatment parameters, such as temperature, exposure time, cooling temperature and time, and/or concentration of carbon (when the heat treatment is a carburizing process), may be identified and selected at this point.

If a carburizing case hardening process is selected, another step can include placing body 101, 101' into a carbon-rich environment, such as a carburizing chamber, which includes a quantity of carbon. In one embodiment, the carbon-rich environment may be created by surrounding the selected material with carbon monoxide or any other carbon rich substance. While in the carbon-rich environment, body 101, 101' may be heated to a predetermined temperature, as determined or previously determined. The predetermined temperature and the exposure time may vary, with higher temperatures and longer exposure times resulting in a more brittle material due to increased penetration or absorption of carbon deeper into body 101, 101'. During this step, the material of body 101, 101' absorbs some of the carbon from the surrounding environment. Longer exposure times mean more carbon may be absorbed into the material, which may result in a more brittle body 101, 101'. More particularly, because body 101, 101' defines an open outer shell portion 3 and an open inner shell portion 7, both outermost and innermost depths 130, 134 may be exposed to the carbon-rich environment. As such, the material properties at both outermost and innermost depths 130, 134 of body 101, 101' may be modified during the heat treatment process. In one embodiment, if body 101, 101' is comprised of steel, then by heat treating the material of body 101, 101' in a carbon-rich environment during sixth step 406, outermost and innermost depths 130, 134 may undergo a phase transformation to martensite with a body centered tetragonal ("BCT") crystal structure, thereby increasing the brittleness and hardness at outermost and innermost depths 130, 134 relative to intermediate depth 132. Intermediate depth 32 may maintain the natural hardness of the material of body 101, 101', depending on the heat treatment parameters (e.g., exposure time).

Following heat treatment steps, body 101, 101' may be cooled. In one embodiment, body 101, 101' may be quenched. Cooling allows the material of body 101, 101' to capture the carbon it absorbed.

Once the heat treatment cycle is completed, body 101, 101' may be further modified to include additional features of fragmentation device 100, 100'. For example, outer (female) shell portion 3 may be further modified to include aperture 118 for receiving explosive material 103 and detonation device 112. After explosive material 103 is received within fragmentation device 100, 100', fragmentation device 100, 100' may be sealed. For example, outer and inner shell portions 3, 7 may be coupled together and/or detonation device 112 may be sealed against body 101, 101'. In one embodiment, outer and inner shell portions 3, 7 may be snap fit coupled together to contain explosive material 103 therein.

In some embodiments, because outermost and/or innermost depths 130, 134 of body 101, 101' are made more brittle through the heat treatment process, fragmentation device 100, 100' can also be configured for approximately 100% fragmentation along valleys 106, 106' when explosive material 103 is ignited with detonation device 112. More particularly, in some embodiments a combination of increasing the hardness of outermost and/or innermost depths 130, 134 of body 101, 101' and providing body 101, 101' with valleys 106, 106', which define stress points within body 101, 101', allows for increased fragmentation of fragmentation device 100, 100' during a fragmentation or an explosive event.

Figure 10:
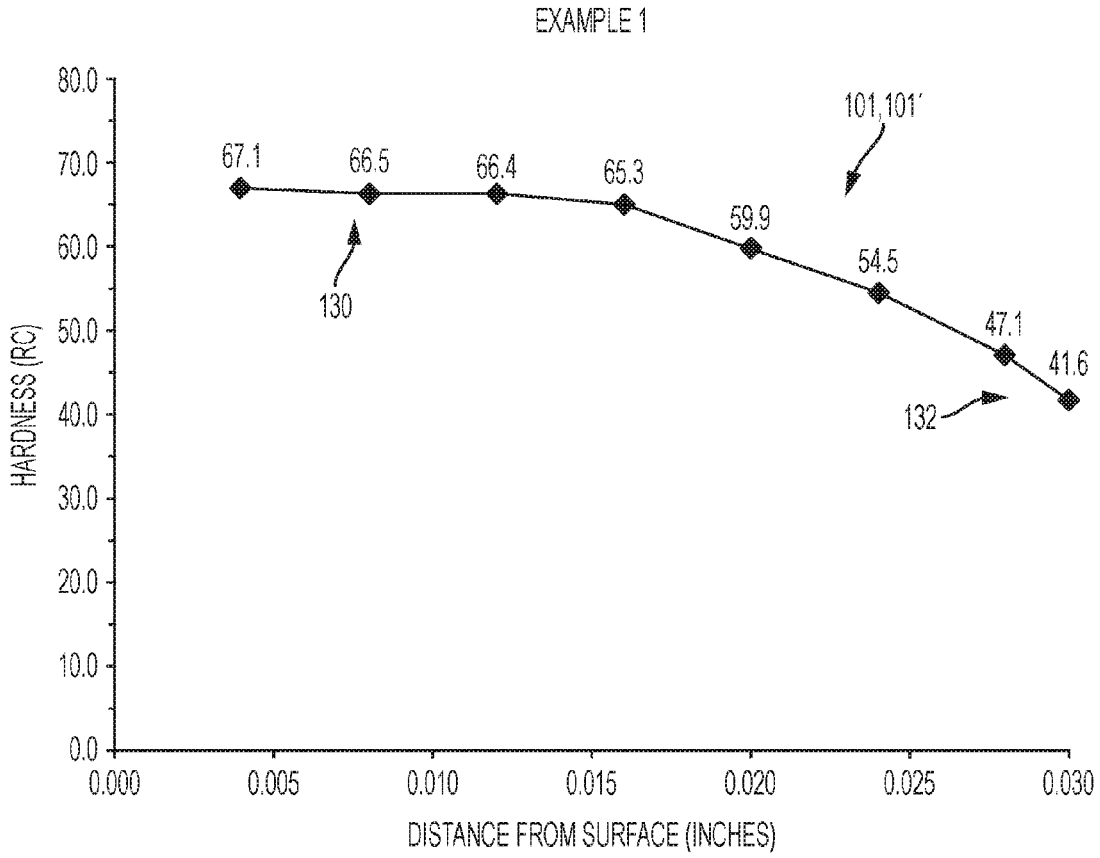
FIG. 10 shows a graphical representation of exemplary hardness values or a profile of a surface of an exemplary embodiment of the present disclosure.

FIG. 10 shows a graphical representation of exemplary hardness values or a profile of a surface of an exemplary embodiment of the present disclosure. More particularly, body 101, 101' of Example 1 (FIG. 10) may be carburized to increase the carbon content at outermost depth 130 and/or innermost depth 134 relative to intermediate depth 132 (FIG. 9F). For example, as shown in FIG. 10, Example 1 of fragmentation device 100, 100' may include a hardness value at outermost depth 130 of body 101, 101' of 65-70 Rockwell C and, more particularly, a hardness value of 65.3-67.1 Rockwell C. However, as the distance from outermost depth 130 increases toward intermediate depth 132, the hardness of body 101, 101' decreases to a hardness value of 40-60 Rockwell C and, more particularly, 41.6-59.9 Rockwell C. In this way, intermediate depth 132 has more ductility than outermost depth 130 of body 101, 101'. However, by increasing the carbon content at outermost depth 130, the hardness at outermost depth 130 also increases and brittle fracture may occur more easily at each valley 106, 106' such that increased fragmentation occurs in fragmentation device 100, 100'.

Figure 11:
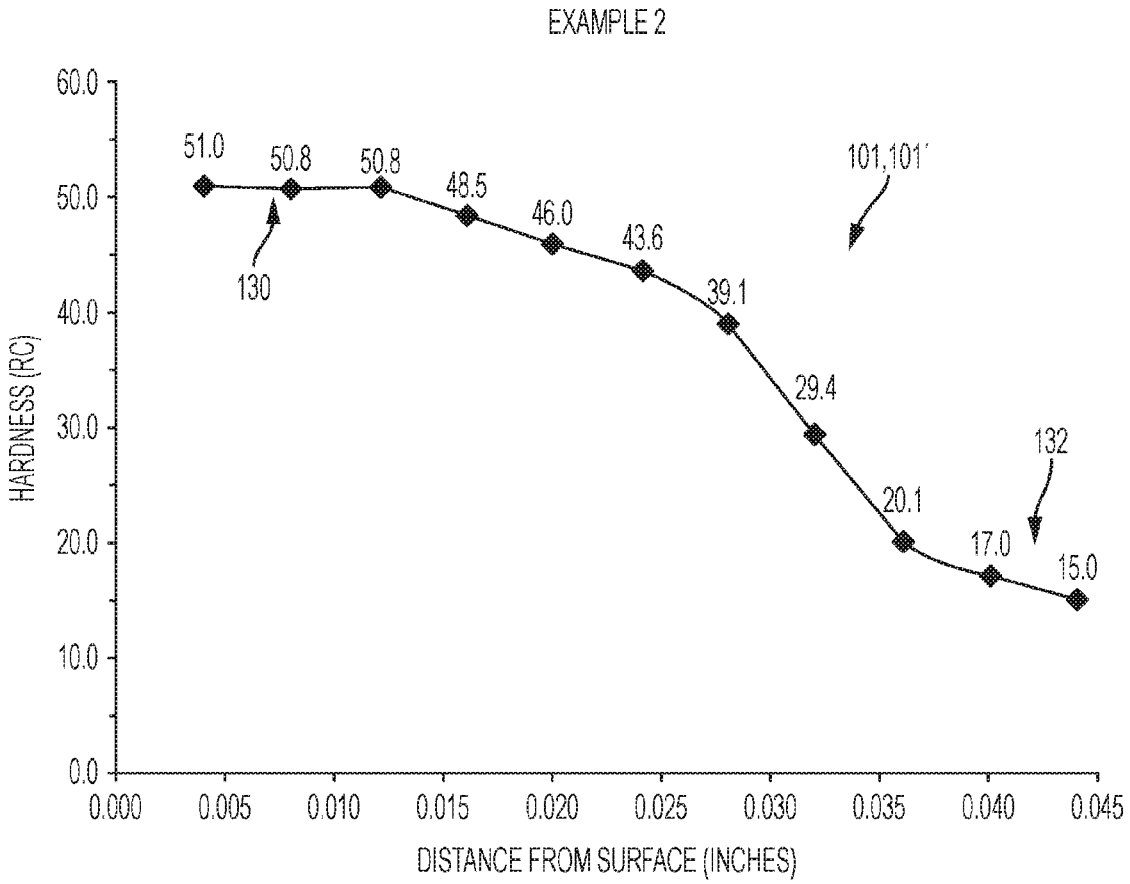
FIG. 11 shows a graphical representation of exemplary hardness values of a surface of another exemplary embodiment of the present disclosure.

FIG. 11 shows a graphical representation of exemplary hardness values of a surface of another exemplary embodiment of the present disclosure. As show in Example 2 of FIG. 11, body 101, 101' of Example 2 may be carburized to increase the carbon content at outermost depth 130 and/or innermost depth 134 relative to intermediate depth 132 (FIG. 9F). By increasing the carbon content at outermost depth 130 and/or innermost depth 143, the hardness of those portions of body 101, 101' increases. For example, the hardness values at outermost depth 130 of body 101, 101' may be 40-55 Rockwell C and, more particularly, a hardness value of 43.6-51.0 Rockwell C. However, as the distance from outermost depth 130 increases toward intermediate depth 132, the hardness of body 101, 101' decreases to a hardness value of 10-40 Rockwell C and, more particularly, 15.0-39.1 Rockwell C. In this way, intermediate depth 132 has more ductility than outermost depth 130 of body 101, 101'. However, by increasing the carbon content at outermost depth 130, the hardness at outermost depth 130 also increases and brittle fracture may occur more easily at each valley 106, 106' such that increased fragmentation occurs in fragmentation device 100, 100'.

Figure 12:
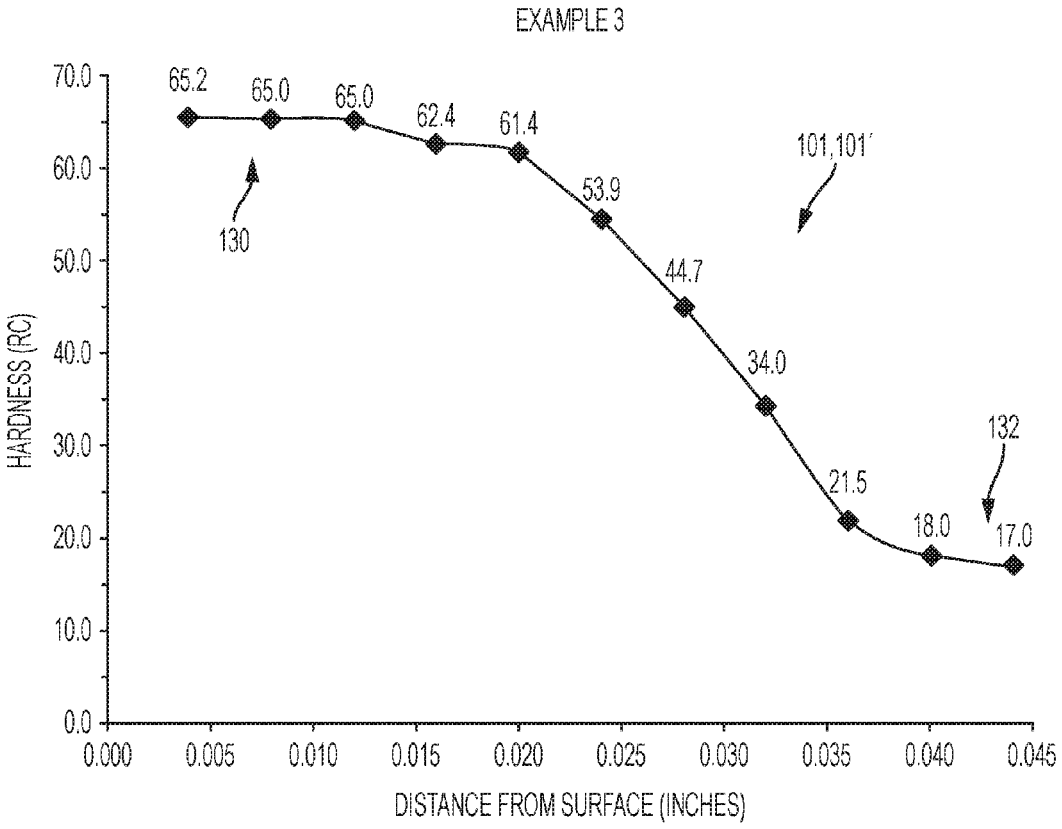
FIG. 12 shows a graphical representation of exemplary hardness values of a surface of a further exemplary embodiment of the present disclosure.

FIG. 12 shows a graphical representation of exemplary hardness values of a surface of a further exemplary embodiment of the present disclosure. Additionally, as show in Example 3 of FIG. 12, body 101, 101' of Example 3 may be carburized to increase the carbon content at outermost depth 130 and/or innermost depth 134 relative to intermediate depth 132 (FIG. 9F). By increasing the carbon content at outermost depth 130 and/or innermost depth 143, the hardness of those portions of body 101, 101' increases. For example, the hardness values at outermost depth 130 of body 101, 101' may be 60-70 Rockwell C and, more particularly, a hardness value of 61.4-65.2 Rockwell C. However, as the distance from outermost depth 130 increases toward intermediate depth 132, the hardness of body 101, 101' decreases to a hardness value of 10-60 Rockwell C and, more particularly, 17.0-53.9 Rockwell C. In this way, intermediate depth 132 has more ductility than outermost depth 130 of body 101, 101'. However, by increasing the carbon content at outermost depth 130, the hardness at outermost depth 130 also increases and brittle fracture may occur more easily at each valley 106, 106' such that increased fragmentation occurs in fragmentation device 100, 100'.

Figure 13A:
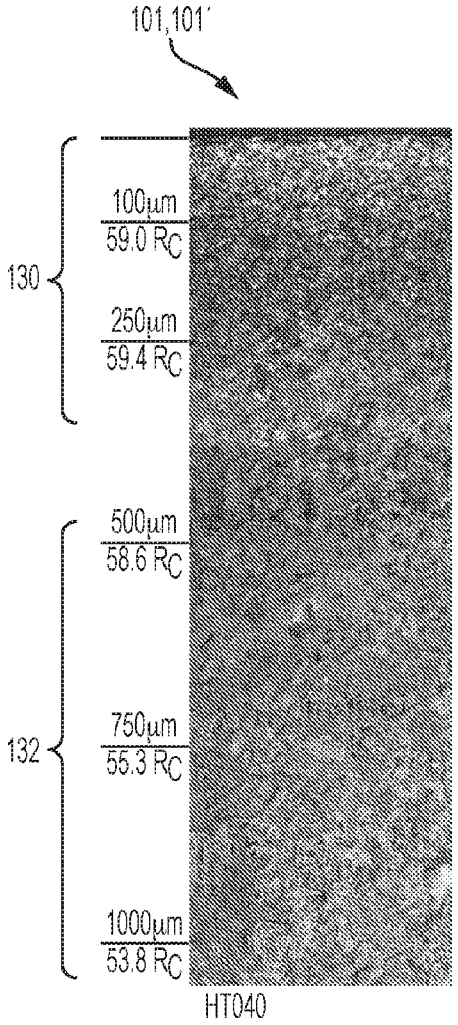
FIG. 13A shows a first micrograph of a surfaces of an exemplary structure or assembly, e.g., a fragmentation device, of the present disclosure.
Figure 13B:
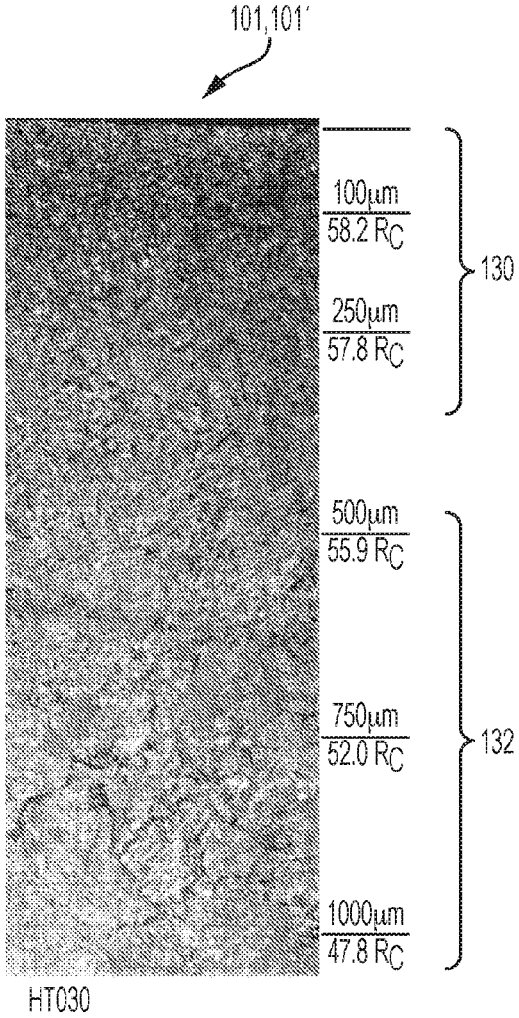
FIG. 13B shows a second micrograph of a surfaces of an exemplary structure or assembly, e.g., fragmentation device, of the present disclosure.

Referring to FIGS. 13A and 13B, two different samples of body 101, 101', processed at different conditions during the heat treatment cycle, are shown. FIGS. 13A and 13B show that the microstructure of outermost depth 130 of body 101, 101' is different from the microstructure of intermediate depth 132 of body 101, 101'. More particularly, the microstructure of body 101, 101' changes as the distance from outer surface 108, 108' increases because less carbon is absorbed at an increased distance within body 101, 101' during the heat treatment process. As such, the microstructure at outermost depth 130 shows a martensite phase structure which is different from the microstructure at intermediate depth 132, which may be austenite or another phase of steel.

Figure 14:
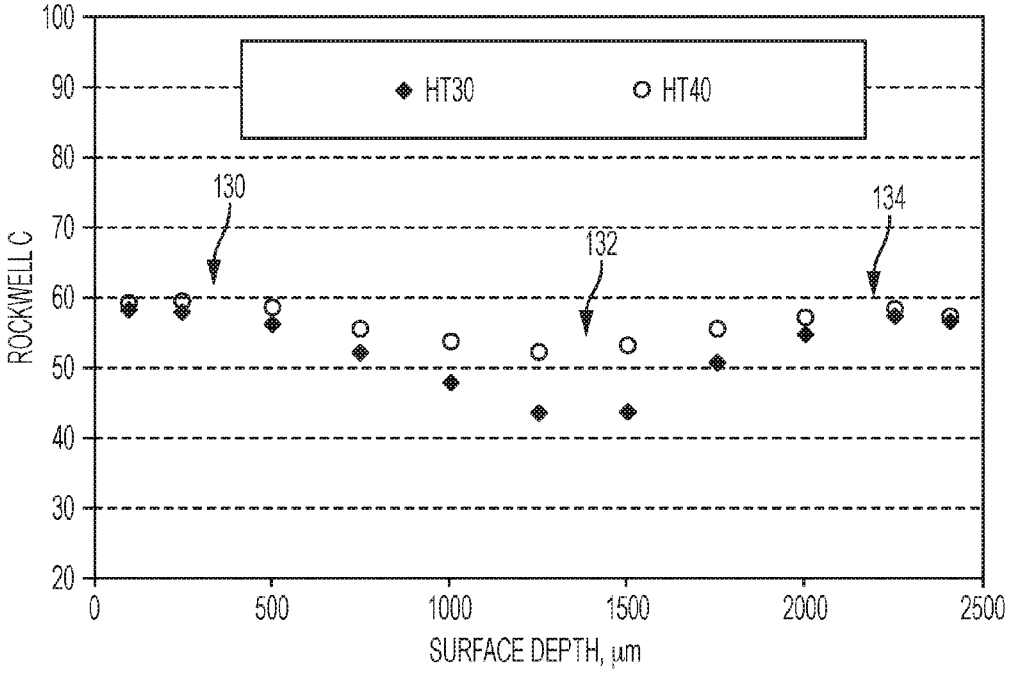
FIG. 14 shows a graphical representation of hardness values associated with the two micrographs of FIGS. 13A and 13B.

Referring to FIG. 14, the hardness values of body 101, 101' of the two different samples of FIGS. 13A and 13B were plotted relative to each other and based on the distance from outer surface 108, 108'. As shown in FIG. 14, the hardness values for each sample at outermost and innermost depths 130, 134 are approximately the same and greater than the hardness value at intermediate depth 132. In this way, brittle fracture occurs more easily at valleys 106, 106', which define stress points within body 101, 101', during an explosive event due to the combination of valleys 106, 106' and the modification of the hardness of body 101, 101'. As such, fragmentation device 100, 100' allows for increased fragmentation during an explosive event.

FIG. 15A shows an exemplary method of producing an embodiment of the present disclosure. For example, one case hardening treatment can harden an exterior surface of an enclosure or structure formed in accordance with one or more embodiments of the invention. For example, referring to FIG. 15A at Step 301: Form material into an enclosure comprising a first and second section that when assembled defines first and second wall sides, said first and second sections each respectively defining a first and second cavity section when assembled at a joint section of said enclosure, wherein said first wall side is formed with a first side and second side opposing said first side as well as a first joint interface section, said second side is formed to define a first circumference of at least some of said first cavity section, wherein said second wall side is formed with a third side and fourth side opposing said second side as well as a second joint interface section, said third side is formed to define a second circumference of said second cavity section, said second joint interface section is formed to insertably receive and retain said second joint interface section; wherein said first joint interface section (FEMALE) is formed with a first, second, and third interlocking section formed at a first end of said first wall defining a first aperture into said first cavity section, said first interlocking section forms a first rib or protrusion extending away from said second interlocking section, said first interlocking section is formed with a first inwardly tapered geometry or profile defined by a first angle extending inwardly from said first side and increasing in thickness from said first end to a first shoulder section of said first interlocking structure, said first interlocking section is formed with said first shoulder section defining a first transition between said first interlocking section to said second interlocking section, said first shoulder formed with a shoulder wall extending perpendicularly away from said second interlocking section, said second interlocking section has a different thickness than said first or third interlocking sections wherein said second interlocking section's thickness is less than said first or second interlocking sections, said third interlocking section is formed with a second inwardly tapered geometry or profile defined by a second angle extending inwardly from said first side and increasing in thickness from a second transition between said second and third interlocking sections to a second shoulder formed into said first section that extends away from said third interlocking section to said second side of said first wall, wherein said first interlocking section has a chamfered or rounded edge at said first end at said first aperture's edge to facilitate said second section insertion into said first section; wherein said second joint interface section (MALE) is formed with a fourth, fifth, and sixth interlocking section formed at a second end of said second wall defining a second aperture into said second cavity section, said second and third interlocking sections defines a channel or recess in said second side adapted to receive and interlockably retain said fifth and sixth interlocking sections, wherein said fifth interlocking section extends away from said fourth interlocking section forming a second rib or protrusion, said fourth interlocking section further defined by a third shoulder at a third transition section between said fourth and fifth interlocking sections, said second section's third shoulder engages with said first shoulder of said first section, wherein said fourth, fifth, and sixth section are formed having a shape or profile defined to insertably engage with said first, second, and third interlocking sections with an interference snap fit that displaces said first and second wall sections until said fifth and sixth interlocking sections snap fits into said first channel or recess, wherein said first joint interface section and at least some adjacent area of said first section is formed having a lesser wall thickness than said second joint interface section and at least some adjacent area of said second section to said second joint interface area.

Figure 15B:
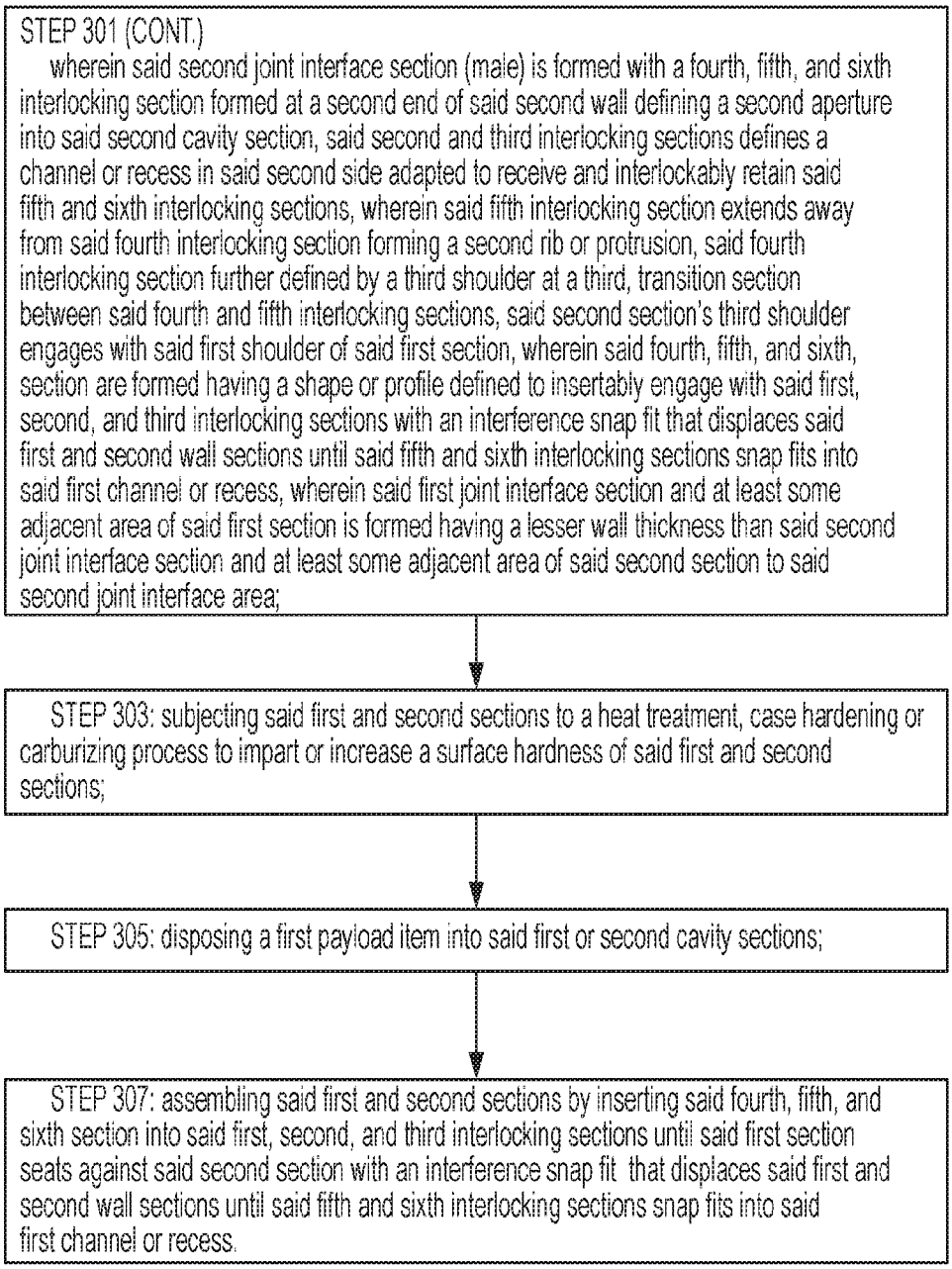
FIG. 15B shows a continuation of the FIG. 15A method.

Referring to FIG. 15B at Step 303: subjecting said first and second sections to a heat treatment, case hardening or carburizing process to impart or increase a surface hardness of said first and second sections. At Step 305: disposing a first payload item into said first or second cavity sections. At Step 307: assembling said first and second sections by inserting said fourth, fifth, and sixth section into said first, second, and third interlocking sections until said first section seats against said second section with an interference snap fit that displaces said first and second wall sections until said fifth and sixth interlocking sections snap fits into said first channel or recess.

Alternative embodiments can include structures besides an enclosure or container or other variations of structures which use snap-fit type engagement or coupling structures. Embodiments can also include various types of materials which can be subjected to a process or formed with material properties which provide suitable coupling force, enable or facilitate a fracturing or fragmentation result from a predetermined force, as well as providing a structure which has a desired or needed degree of structural strength which permits rough handling of the coupling structure, among other things.

Although the invention has been described in detail with reference to certain preferred embodiments, variations and modifications exist within the spirit and scope of the invention as described and defined in the following claims.

The invention claimed is:

1. An assembly comprising:

an enclosure formed from one or more materials comprising a first and second section, said first section comprising a first wall surrounding and defining a first cavity section, said second section comprising a second wall surrounding and defining a second cavity section, said first and second sections are adapted to be assembled at a joint section of said enclosure;

wherein said first wall comprises a first and second wall side, wherein said first wall side is formed as an opposing side of said first wall from said second wall side, said first wall further comprises a first joint interface section;

wherein said second wall comprises a third wall side and fourth wall side, wherein said third wall side is formed as an opposing side of said second wall from said fourth wall side, said second wall further comprises a second joint interface section;

wherein said first joint interface section is formed to insertably receive and retain said second joint interface section;

wherein said first joint interface section (FEMALE) is formed with a first, second, and third interlocking section formed at a first end of said first wall, said first end defining a first aperture into said first cavity section, said first interlocking section forms a first rib or protrusion perpendicular to said second wall side, said first interlocking section is formed with a first inwardly tapered geometry or profile defined by a first angle extending inwardly from said first wall side and increasing in thickness from said first end to a first shoulder section of said first interlocking section, said first interlocking section is formed with said first shoulder section defining a first transition between said first interlocking section to said second interlocking section, said first shoulder formed with a shoulder wall extending perpendicularly away from said second interlocking section, said second interlocking section has a different thickness than said first or third interlocking sections wherein said second interlocking section's thickness is less than said first or second interlocking sections, said third interlocking section is formed with a second inwardly tapered geometry or profile defined by a second angle extending inwardly from said first wall side and increasing in thickness from a second transition between said second and third interlocking sections to a second shoulder formed into said first section that extends away from said third interlocking section to said second side of said first wall, wherein said first interlocking section has a chamfered or rounded edge at said first end at said first aperture to facilitate said second section insertion into said first section;

wherein said second joint interface section is formed with a fourth, fifth, and sixth interlocking section formed at a second end of said second wall defining a second aperture into said second cavity section, said second and third interlocking sections defines a first channel or recess in said second side adapted to receive and interlockably retain said fifth and sixth interlocking sections, wherein said fifth interlocking section extends away from said fourth interlocking section forming a second rib or protrusion, said fourth interlocking section further defined by a third shoulder at a third transition section between said fourth and fifth interlocking sections, said second section's third shoulder engages with said first shoulder of said first section, wherein said fourth, fifth, and sixth interlocking sections are formed having a shape or profile defined to insertably engage with said first, second, and third interlocking sections with an interference snap fit that displaces said first and second wall sections until said fifth and sixth interlocking sections snap fits into said first channel or recess, wherein said first and second sections comprise at least one of case hardening or embrittlement process of a first hardening or embrittlement formed or created by a heat treatment, case hardening or carburizing process to impart or increase a surface hardness of said first and second sections;

wherein said fourth, fifth, and sixth interlocking sections are disposed into said first, second, and third interlocking sections so that said first section is seated against said second section with an interference snap fit such that said fifth and sixth interlocking sections has a snap fit into said first channel or recess;

wherein said first joint interface section and at least some adjacent area of said first section is formed having a lesser wall thickness than said second joint interface section and at least some adjacent area of said second section to said second joint interface area;

wherein said enclosure is formed around materials to create a fragmentation device comprising an exemplary smooth inner surface, a hexagonal patterned exemplary outer surface defined as raised portions alongside valleys within the material of body that surrounds explosive material;

wherein said process comprises different hardness factors creating hexagonal patterned exemplary outer surface that create patterns for brittleness to fracture upon explosive material projection; and wherein said process produces alteration of said regions between said hexagonal shapes so that metal in said regions has a different hardness than metal in said hexagonal areas.

2. An assembly as in claim 1, further comprising a first payload item disposed into said first or second cavity sections.

3. An assembly as in claim 1, wherein said one or more materials comprises steel.

4. An assembly as in claim 1, wherein said first joint interface structure is formed comprising a female structure.

5. An assembly as in claim 1, wherein said second joint interface structure is formed comprising a male structure.

* * * * *